United States Patent [19]

Iwanicki

[11] Patent Number: 4,506,720

[45] Date of Patent: Mar. 26, 1985

[54] INSULATION CURTAIN

[76] Inventor: Andrzej T. Iwanicki, Östrandsvägen 72, S-122 43 Enskede, Sweden

[21] Appl. No.: 579,802

[22] PCT Filed: Mar. 26, 1980

[86] PCT No.: PCT/SE80/00087

§ 371 Date: Nov. 17, 1980

§ 102(e) Date: Nov. 17, 1980

[87] PCT Pub. No.: WO80/02036

PCT Pub. Date: Oct. 2, 1980

Related U.S. Application Data

[63] Continuation of Ser. No. 224,566, filed as PCT SE 80/00087, Mar. 26, 1980, published as WO 80/02036, Oct. 2, 1980, § 102 (e) date Nov. 17, 1980, abandoned.

[30] Foreign Application Priority Data

Mar. 26, 1979 [SE] Sweden ..... 7902682

[51] Int. Cl.[3] ..... E06B 9/08; E06B 7/21

[52] U.S. Cl. ..... 160/26; 160/121 R

[58] Field of Search ..... 160/238, 120, 121, 122

[56] References Cited

U.S. PATENT DOCUMENTS 3,231,006 1/1966 Fisher et al. ..... 160/41

3,298,142 1/1967 Isaac ..... 52/2

4,038,788 8/1977 Claessens ..... 52/15

4,187,896 2/1980 Shore ..... 160/121

*Primary Examiner*—Peter M. Caun

*Assistant Examiner*—Cherney S. Lieberman

*Attorney, Agent, or Firm*—Oblon, Fisher, Spivak, McClelland & Maier

[57] ABSTRACT

The invention relates to an insulating curtain consisting of an inflatable element (1) which in an inflated condition is intended to cover a surface area and in a deflated condition to be stored adjacent said area. The inflatable element comprises airtight portions (9,11) and means which are adapted for filling these portions, the inflatable element thereby being fed out from the store (3). The airtight portions comprise at least one central (9) and at least one peripheral (11) airtight portion and the central portion is substantially airtightly compressible between two compression members (2), along at least a portion of its width, whereby the compressed area will define an inflatable part and a substantially deflated part of the inflatable element. Air ducts (6,7) are disposed within the element and are not compressed by the compression means for enabling the air supply to the airtight portions. Feeding the inflatable element from the store (3) is done by supplying air to the central portion (9).

12 Claims, 53 Drawing Figures

INSULATION CURTAIN

This application is a continuation, of application Ser. No. 224,566 filed as PCT SE 80/0087, Mar. 26, 1980, published as WO 80/02036, Oct. 2, 1980, § 102(e) date Nov. 17, 1980, abandoned.

The present invention relates to an insulating curtain, comprising an inflatable element which is intended to cover a surface area when filled with air, and to be kept in a store adjacent said area in a deflated state, there being means adapted for supplying air to the inflatable element, which contains at least one central and at least one peripheral airtight portion, the means supplying air being adapted for filling the central portion in conjunction with the element being fed out of the store and filling the peripheral portion when the air supply to the central portion is terminated or almost terminated.

Inflatable elements are previously known, for example through U.S. Pat. Nos. 3,298,142, 3,231,006 and DE-OS No. 2 026 260. U.S. Pat. No. 3,298,142 relates to a curtain of an extremely complicated nature where the opposing sheets forming the curtain consist of a resilient steel material containing a plurality of airtight tubes in the longitudinal direction of the curtain, said tubes also consisting of a resilient material. The whole of this structure can be wound up on a roller, for assisting in this there being a plurality of guide rollers arranged in front of the storage roller and intended to flatten out the resilient outer sheets and the inner air-carrying ducts, thus enabling the curtain to be reeled up on the storage roller. Even in a flattened condition the air ducts can, however, supply air from the interior of the storage roller to the area outside the guide rollers, where the resilient material in both outer sheets as well as in the air ducts can assume its natural shape and allow air supply. U.S. Pat. No. 3,231,006 also relates to an insulating curtain. In this case, however, the means are lacking which, according to the invention, are necessary for enabling the curtain to be fed out from the store.

The DE-OS No. 2 026 260 relates to a certain type of insulating curtain intended for separating and sealing rooms in buildings and it can also be used for insulating windows. This curtain is, however, nothing other than an inflatable cushion with regard to its construction, and is intended for placing in a window embrasure, for example.

None of these known structures could come anywhere near to meeting the requirements for an insulating curtain of the type intended by the invention, and which can be placed immediately adjacent a surface area which is to be insulated, and by the supply of air can be fed out from the store and caused to cover said area, and at a subsequent step be caused to seal either against said area or around it, so that both an insulating and a sealing effect are obtained which is absolutely essential if it is desired to obtain good results from the aspect of conserving energy.

The sealing and insulating curtain in accordance with the invention is active against heat and cold as well as noise, air pollution and draughts, and can be used as night-time insulation, for example for display windows, greenhouse windows, french windows and ordinary doors and factory doors. It can also be used to prevent evaporation and thereby heat losses, e.g. from swimming pools and other liquid surfaces.

The object of the present invention is thus to achieve an insulating curtain which can be used for a plurality of different applications when it is a question of preventing heat losses from a surface to the surroundings, while simultaneously constituting an effective seal for dampening noise and preventing the penetration of air pollution.

This object is essentially realized in accordance with the invention in that the central portion is substantially airtightly compressible between two squeezing or compressing members along at least a portion of its width, the compressed area defining an inflatable part in relation to a substantially airless part, and that air ducts are arranged within a part of the element which is not compressible by the compressing members, to connect the inflating means to the airtight portions, and that feeding the element out from the storage takes place by supplying air to the inflatable part of the central portion.

A plurality of embodiments of the invention, selected as examples, are described in detail below while referring to the appended drawings in which FIG. 1 is a cross section of an embodiment of the curtain in accordance with the invention as seen along arrows B of FIG. 2, FIG. 2 is a longitudinal section in a rolled-out state of the curtain according to FIG. 1 as seen along arrows A, FIG. 3 is a plan view of the curtain in FIGS. 1 and 2 reeled in with two compression rollers, FIGS. 4, 5 and 6 illustrate the inflatable element with different configurations of the sealing surfaces, FIG. 7 is a principle sketch of the connection of a plurality of curtains to a common pressure source and control means, FIG. 8 illustrates a curtain with a separate pressure source, FIG. 9 illustrates in perspective a means for regulating the pressure of the compression rollers, FIGS. 10, 11 and 12 illustrate different embodiments of the upper portion of the inflatable element, and its coaction with control means during the reeling-in and reeling-out movement, FIG. 13 is a cross section of a sensing body intended for placing on the upper side of the curtain, FIG. 14 is a cross section of a detail of the rotating shaft coupling according to FIG. 2, with magnetically actuated valves, FIG. 15 is a perspective view of two different embodiments of the outer portions and of the control means, FIG. 16 illustrates a section of the curtain in FIG. 15, FIG. 17 illustrates the bottom portion of the curtain in FIGS. 15 and 16, where the outer portions have not yet been filled with air, and also an alternative embodiment of the store and driving of the rollers, FIG. 18 illustrates an alternative embodiment of the outer and inner portions of the inflatable element, FIG. 19 illustrates a compressing and guiding rail for a curtain in accordance with the invention, FIG. 20 is a cross section of a further embodiment of the curtain in accordance with the invention, FIG. 21 illustrates two section halves, of which the one on the left is section A—A in FIG. 20, and the one on the right is section B—B according to the same Figure, FIG. 22 is a cross section of a curtain according to a still further embodiment of the invention, with a compressed air driven storage shaft, FIG. 23 is a cross-sectional view of FIG. 22 through the storage shaft 3 and between the compression rollers 2, FIG. 24 is a cross section of a shaft coacting directly with a compression means, FIG. 25 is a cross section of a shaft on which two curtains are simultaneously rolled up and intended for reeling out in two directions at right angles to each other, FIG. 26 illustrates a joint in two curtains in accordance with the invention meeting each other in the same plane, FIG. 27 illustrates a reinforced portion with a flap and outside sealing portion for a curtain according to FIG. 26, FIGS. 28 and 29 illustrate storage units with horizontally and vertically displaceable curtains, FIG. 30 is a longitudinal section of a curtain, one end of which consists of a displaceable sheet on which both the outside and the inner portion are attached, FIG. 31 is a section in plan of the curtain in FIG. 30, FIG. 32 is a cross section of the curtain in FIG. 30, FIG. 33 is a perspective view of a counterpressure roller according to FIGS. 30–32, FIG. 34 is an embodiment of the curtain with an insulating sheet which can suitably be driven horizontally since the displacement of the sheet in both directions takes place by means of separate air supply to opposing parts of the inner portion, FIG. 35 illustrates a further embodiment of the curtain in accordance with the invention in which the outer and inner airtight portions are separated and each lies on a separate substructure and the compression roller is attached to the displaceable sheet, FIG. 36 illustrates the section A—A in FIG. 35, FIG. 37 is a plan view of a curtain with built-in compressed air supply in the storage shaft, FIG. 38 is a cross sectional view along the line A—A in FIG. 37, showing a reinforced edge with a compressed air chamber, FIG. 39 is a cross section of the storage shaft in FIG. 37 formed as a compressed air source, FIG. 40 is a cross section of an inner portion with compressed air filled ducts, FIG. 41 is a cross section of the curtain in FIG. 40 after removing air from the duct, FIG. 42 is a section of the curtain in FIG. 31 with filled sealing portion, FIG. 43 is a longitudinal section of a curtain with the storage shaft and compression means arranged in a cassette which is movable upwards and downwards on filling and emptying, respectively, of the inner portion, FIG. 44 is a plan view of a detail of the embodiment in FIG. 43 with guide rail and a wheel running along the rail, FIG. 45 is a cross section of the curtain in FIG. 43, from which it will be seen that the bottom edge of the curtain is rigidly attached to a substructure and to the compressed air source, FIG. 46 illustrates with the same view as in FIG. 44 an alternative embodiment of the guide rail, FIG. 47 is a detail of the guide rail in FIG. 45, FIG. 48 is a section of a side element with the guide rail and a sealing portion which is filled simultaneously as the sealing portion rolls up on the shaft, FIG. 49 is a section of a curtain, the upper edge of which is connected to a separately reelable protective net, FIG. 50 is a section of a curtain surrounded on both sides by stiff and foldable protective sheets, FIG. 51 is a perspective view of collapsible guiding and sealing rods in different stages of being folded out and driven by the upper edge of the curtain, FIG. 52 is a plan view of a sealing joint between two parallel-driven curtains with pressure differentiation between outer and inner portions, FIG. 53 similarly illustrates a sealing joint where the sealing effect is obtained by means of opposing pressure rods.

The curtain in accordance with the invention, illustrated in FIGS. 1–3, includes an inflatable element 1, comprising a central portion 9 and two sealing portions 11 on either side thereof. According to this embodiment the inflatable element is wound up on a storage shaft 3 which in turn is enclosed in a supporting casing or cassette 4. The storage shaft 3 is connected to a compressed air source via the air supply pipe 5, and air is introduced at one end of the shaft, from where it is led via a duct 6 to the central portion and also via a duct 7 to the side and sealing portions 11. The central portion 9 is taken between two compression rollers 2 supported in bearings 25 (see FIG. 17) at their ends and pressing against the inflatable element from both sides so that there is formed an area which defines a part to which air is introduced via the duct 6 and an airless portion lying thereunder. The compression rollers 2 extend along the whole width of the central portion 9 and the air ducts 6 and 7 must consequently be arranged in one of the sealing portions 11. The air is thus supplied through one end of the storage shaft 3 and is distributed to the airtight portions with the aid of a valve means as is apparent from FIG. 14. The valve means comprises a closing valve 16 for the duct 6 which takes air to the central portion, and a valve 17 for air supply to both sealing portions. The sealing portions communicate with each other via a continuation of the ducts 7 arranged at the top edge of the curtain. The curtain is suitably produced from a soft and airtight material such as plastic film or a non-woven textile, and the central portion can suitably be built up from parallel segments and in several layers in the reeling direction of the curtain, said segments having certain air communication with segments lying above and below, but are airtightly compartmented off at the sides with respect to adjacent segments. The upper part of the curtain is provided with a stiff edge 10 which is formed for being able to guide the curtain against rigid guide rails 12 when it is being fed in or out from the storage shaft, and for fixing the curtain in a desired position when filling the sealing portions. To set desired pressure between the compression rollers 2, there are roller adjusting means 14, as is apparent from FIG. 9, comprising spacer wedges 28 which act on the wheels 27. The spacer wedges are displaced with the aid of a screw 29 which is used to set the desired roller pressure. The sealing portions can have an optional configuration depending on how the curtain is placed in relation to the surface area which is to be insulated. In FIG. 6 an embodiment is illustrated where the sealing portions are caused to expand in a direction substantially transverse of the curtain, the guide elements 13 being intended for stabilizing the side portions. FIG. 5 illustrates an alternative embodiment of the curtain with a reinforced upper portion 10*a* which is apparent in detail from FIG. 11. In this embodiment the sealing portions 11 are caused to expand in two directions at right angles to each other in a plane at right angles to the longitudinal direction of the curtain. The reinforced edge 10 can suitably be provided with a sensing means, as is apparent from FIG. 13, and which is indicated in FIGS. 2 and 3. This sensing means is actuated when the central portion has reached its upper end position and the sensing body 37 comes against a surface or stop, whereby the valves 16 and 17 are actuated so that filling the sealing portions 11 is begun while the central portion is being filled. The pressure in the central portion as well as in the sealing portions is sensed by a sensor means 37 which is centrally placed, according to FIG. 7, air supply to these portions ceasing when desired pressure has been achieved. According to the embodiment shown in FIG. 2, re-reeling of the curtain is done with the aid of a helical spring 19 which is wound round the inner shaft 18 of the storage shaft 3. The spring is rigidly fastened by means of an attachment on the shaft 21 and an attachment 20 on the inside of the storage shaft. During the reeling-out movement, when the curtain is reeled from the storage shaft, the spring 19 is charged with energy, and this energy is utilized when the curtain is subsequently reeled back into the store.

A complete cycle of reeling-out and reeling-in will now be described in conjunction with the Figures described above. The cycle is thus begun by manual or automatic actuation of the pressure regulating valve 33 which puts the compressed air chamber 32 in communication with the duct 5, to which the inflatable elements 1 are connected. Air is supplied through the rotating coupling 15 and into the valve means where the valve element 16 for the duct 6 is actuated such that air is let into this duct which is reeled up together with the sealing portion on the outer part of the storage shaft. The duct 6 opens out into the upper part of the central portion 9, and as is apparent from the cross section in FIG. 1, the supply of air to this portion signifies that it is caused to expand, whereby the curtain begins to raise itself simultaneously as it is rolled off the storage shaft 3. This introductory stage is illustrated with dashed lines in FIG. 1. When the inflatable element has attained its completely reeled-out position, the sensor means 37 is actuated, according to FIG. 2, by a surface situated above it, the relay contacts 37 illustrated in FIG. 13 being shorted out, which in turn results in that electromagnetically operated valves 16 and 17 are actuated so that filling the sealing portions is begun simultaneously as filling the central portion is ceased. When desired pressure is obtained, a sensor means in the pressure regulating valve 33 is actuated, air supply to these portions thus ceasing when the desired pressure has been obtained. The arrangement of the sensor means 37 in the curtain is clearly shown in FIG. 2—namely, at the top of the curtain where it can be pressed against the upper wall when the central portion has reached its ultimate reeled-out position. Thus, in that position the sensor means 37, which includes a push button 17*a*, will be pressed downwards so that the relay contacts 37*b* are closed in conventional manner, thereby simultaneously (1) closing the electromagnetically operated valve 16 so that the filling of the central portion is stopped and (2) opening the electromagnetically operated valve 17 to permit air to pass from the duct 7 into the peripheral sealing portions 11. When the curtain is to be reeled back onto the roller, the valve 17 is once again actuated so that the sealing portions 11 are put into communication with the open air via the duct 5, or with a return duct 34. When the pressure in these portions has dropped sufficiently, this is sensed by a diaphragm 37*a* in the sensor means 37, a pair of relay contacts being shorted out to actuate the valve means 16 so that the air in the central portion, 9 can flow out freely. As the air flows out of the central portion the inflatable element is reeled up on the storage shaft and the air outflow is accelerated by the compressing force applied by the compression rollers on the central portion, via the torsional force in the spring 19. When all the air is emptied, the inflatable element is in the starting position, i.e. in the position apparent from the bottom portion of FIG. 1.

The embodiment described above operates in accordance with the basic principle for a curtain in accordance with the present invention and can be applied to a plurality of different variants illustrated on the other drawing Figures. The distinguishing features described above are, however, common to all of these embodiments.

FIG. 15 is a perspective view of two alternative embodiments arranged axially symmetric. In the section in FIG. 16 it is apparent, inter alia, that the left hand half has sealing portions 11 going around the central portion 9 and thus intended to expand in a plane at right angles to the reeling-out direction of the curtain. While FIGS. 15 and 16 illustrate the airtight portions filled with air, FIG. 17 illustrates the curtain during a stage in which only a part of the central portion 9 is inflated, while the sealing portions 11 are substantially deflated. The storage means in this case does not comprise a shaft, the inflatable portions being folded on a rigid substructure. The return movement is carried out in this case with the help of a rack 41*a* driving one of the compression rollers, and is displaceable in a cylinder 38 which is in communication with the compressed air duct 5 and operated by means of the pressure regulating valve 33. Both the magnet-controlled valves 16 and 17 are rigidly adapted on the substructure plate in this embodiment, but are controlled in the same way as in the embodiment example first described. FIG. 18 illustrates how the sealing portions as well as the central portion can be subdivided into segments to give greater stability to the inflatable element. FIG. 19 discloses a guiding rail 13*a* which is guided on upper and lower guide members 12*b* in order to serve as a counter-support for the expanding sealing portion, thereby causing compression of said portion. FIG. 20 illustrates in a cross section the curtain according to FIGS. 15–17, and FIG. 21 illustrates a cross section through both compression rollers driven by the rack 41*a*, the movement of which is translated to the second compression roller by means of the transmission pinion 39*b*, in the same way as is apparent from FIG. 17.

FIGS. 22–23 illustrate an alternative drive for the storage shaft, wherein a compressed air cylinder 38 via a transmission system 39–42 translates an axial movement to a rotational movement via the transmission elements 39, 39*a* which in turn actuate the storage shaft 3 and achieve its rotation. Depending on whether the inflatable element is to be reeled in or reeled out, the air is directed by means of the pressure regulating valve 33, either into the duct 5 from which air is then taken to the airtight portions, or also to the cylinder 38 for reeling in the curtain. FIG. 24 illustrates an alternative arrangement of the compression means wherein one means constitutes the storage shaft, while the other means is a compression roller 2 loaded by a spring 47. FIG. 25 illustrates a further embodiment in which two inflatable elements are reeled up on the same storage shaft 3*a* and where the curtains are provided with reinforced portions 10*b* and 10*c* and intended for reeling out in two directions at right angles to each other. The angular direction can naturally be selected optionally. FIG. 26 illustrates how two curtains can be caused to seal against each other, e.g. in insulating and sealing large surfaces which cannot be covered by a single curtain, and for this purpose the reinforced edges 10c are provided with valves 44a and outer sealing portions 11b which resiliently press against each other.

FIG. 27 illustrates the left portion of the reinforced edge 10c shown in FIG. 26 before the sealing portions 11b have been expanded to press against each other as shown in FIG. 26. Thus, the valves 44a are shown as flaps which are rotably mounted on hinges 45 to permit outward swingable movement when the sealing portions are expanded from the position shown in FIG. 27.

FIGS. 28 and 29 show different embodiments of cassettes in which the curtains can be reeled out in four different directions. The cassettes can be arranged either horizontally as shown in FIG. 28 or vertically as shown in FIG. 29.

FIGS. 30–39 illustrate curtain arrangements in which the inflatable element is connected to an insulating slab or sheet which by filling and emptying the airtight portions can be caused to cover the surface area which is to be insulated. FIGS. 30–32 illustrate an embodiment where the central portion 9 and side portions 11 are attached to an insulating sheet 56 and the compression means constitute the sheet 56 and a roller 2 lying against the sheet thereby to achieve the air-sealing action. When air is let in via the duct 6 to the central portion, the sheet as well as the inflatable element are displaced upwards, as is indicated in FIG. 32. In this embodiment, the ducts 6 and 7 can be attached directly to one edge of the sheet, and thus accompany the movement when the sheet is displaced upwards. The curtain is returned to the starting position by the action of (a) the weight of the sheet 56, (b) separate weights 53, and the condition for movement is that it takes place vertically. To achieve the desired compression action between the sheet 56 and the roller 2, there is a counterpressure roller 54 arranged in a fixing 55 on the opposite side of the sheet. In this embodiment ducts 6 have been arranged leading to the central portion inside the insulating sheet 56, which have made it possible to extend the compression roller 2 to the whole width of the sheet. This is naturally dependent on the duct 6 lying protected in the sheet, so that the side portions 11c do not need to be utilized for ducts.

The embodiment according to FIG. 34 relates to a curtain in principle agreeing with the curtain according to FIGS. 30–32, but which is intended for horizontal displacement. According to this embodiment air can thus be taken separately to both sides of the compression means. In displacement upwards in the Figure the air is taken into the upper part of the central portion, the curtain thus being displaced in this direction. For downward displacement in the Figure, the air is introduced into the lower part simultaneously as the upper part is emptied of air.

FIG. 35 illustrates an embodiment of the invention in which the inner and outer portions are separated and each attached to a separate substructure. The inner portion 9c is attached to a substructure 56b suitably in the form of a slab or sheet, which in turn is rigidly attached to a wall portion or the like. The compression means in this case constitutes the roller 2a which rolls and presses against the sheet 56, and since air is supplied through the ducts 6 to this part of the central portion, which is either above or below the compressed portion, the insulating sheet 56 is displaced upwards or downwards in the Figure. The sealing portion is similarly attached to this sheet, and when the sheet is brought into a completely fed-out position, the filled portion is sealed in accordance with the inventive concept. Through this arrangement the area included in the storage part will also be sealed and insulated. Furthermore, a sealing portion 11d is inflated when the movement is terminated and the insulating sheet 56 in place.

The embodiment illustrated in FIG. 37 relates to a curtain with its own compressed air source which comprises a compressor 57 driven by an electric motor 58. FIG. 38 is a cross section of a compressed air chamber 59 connected to the compressor 57 via the ducts 5. FIG. 39 is a cross section through the compressor.

FIG. 42 is a cross section through the curtain in FIG. 36, and from which it is apparent that the arrangement with the central portion and the sealing portions otherwise agrees with the basic concept of the invention.

FIGS. 40 and 41 illustrate an alternative embodiment of the massive slabs or sheets illustrated in FIGS. 32–35. According to this embodiment, the insulating sheet 56 comprises an inner and outer sheet 65 which are separated by air ducts 6a which are filled with air simultaneously as the central portion is supplied with air, whereby an increased sealing action between the compression means is obtained.

FIGS. 43–47 illustrate an embodiment in which the storage part is caused to carry out the inward and outward feed movements while the edge portions of the curtain are attached to a horizontal substructure. In accordance with previous embodiments, the inflatable element is reeled up on a storage shaft 3 coacting with a spring-actuated compression roller 2, and the whole arrangement is accommodated in a storage part or supporting casing 74. Air supply to the central portion as well as to the outer portions takes place through the air ducts 6 and 7 in the same way as in previously described embodiments. Since the storage part 74 in this embodiment has a certain weight, an automatically functioning safety device 78 has been constructed which retains the storage part in a desired position and to which air is supplied via the duct 7 simultaneously as air is supplied to the sealing portions. Thus, this signifies that only when the storage part 74 has reached its upper end position, i.e. when the central portion is filled with air, air is supplied to this locking means, in which a pivotably mounted arm 76 with a pawl 77 is turned so that it locks the storage part 74 in the upper position when air expands an inflatable portion 75 in the locking means. The storage part is provided with wheels 70 and 71 which roll in a groove to one side of the curtain.

The storage part 74 contains the storage shaft 3 and compression roller 2 and is displaced upwards as air is supplied to the central portion through the duct 6. It will be seen from FIG. 44 that the storage shaft or roller 3 has an outer wheel 3a on which a band 68 can be reeled. The storage part 74 is guided during its movement by means of a C-shaped rail 88a in which a runner is displaceable. The runner is provided with wheels 70 rolling against one flange of the rail, the band 68 being reeled on or reeled off the wheel 3a on the storage shaft 3 during the movement of the curtain upwards or downwards. The band 68 is attached to the upper edge of the rail and is thus completely reeled up on the wheel 3a when the storage part 74 is in its upper position, i.e. when the curtain is completely rolled off from the storage shaft. The object of the band is to compel the storage shaft 3 to rotate when the curtain is reeled up on the storage shaft when deflating the inflatable portions, and the cassette moves downward by gravity. The rail is provided with a flange 69 intended to guide the reeling on and reeling off of the band from the wheel 3*a*, and the flange edge has a given slope to plumb, as apparent from FIG. 45 to accommodate the flange to the outside diameter of the wheel and band as the band is reeled on or reeled off it.

Figure 1:
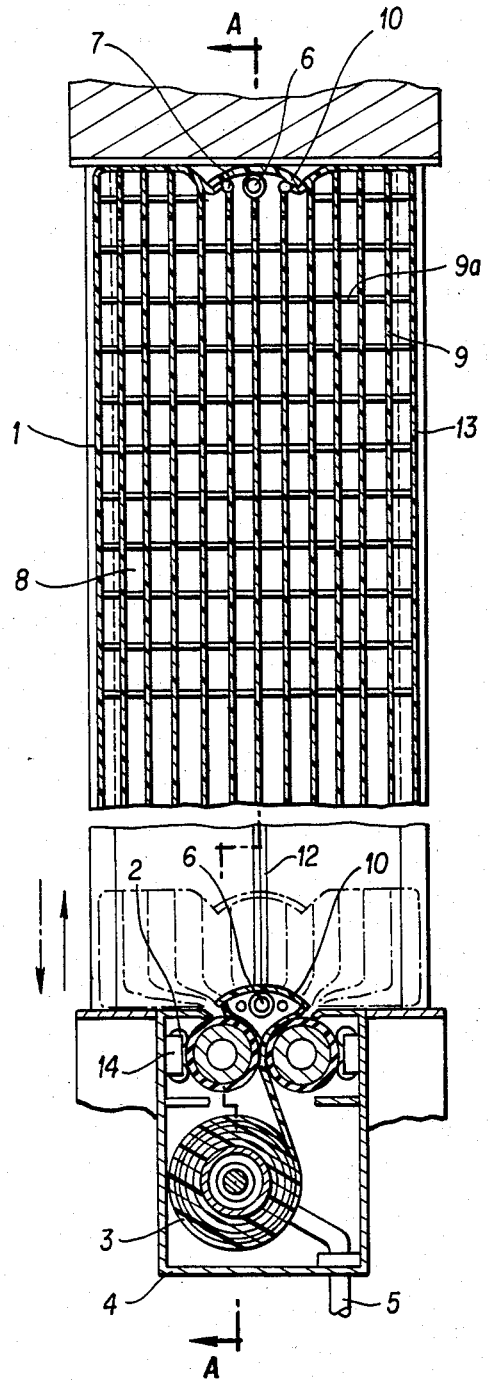
Figure 2:
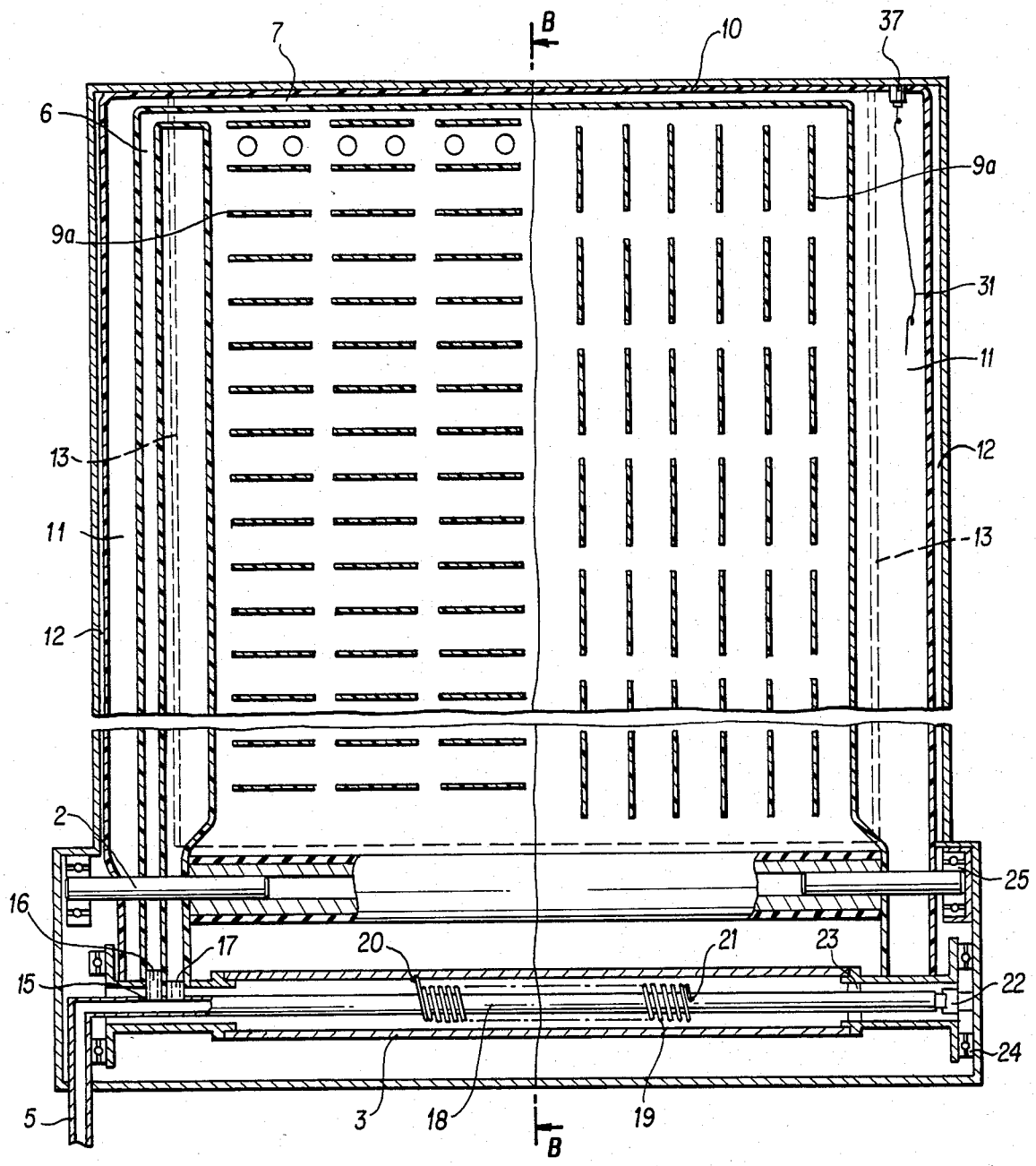
Figure 3:
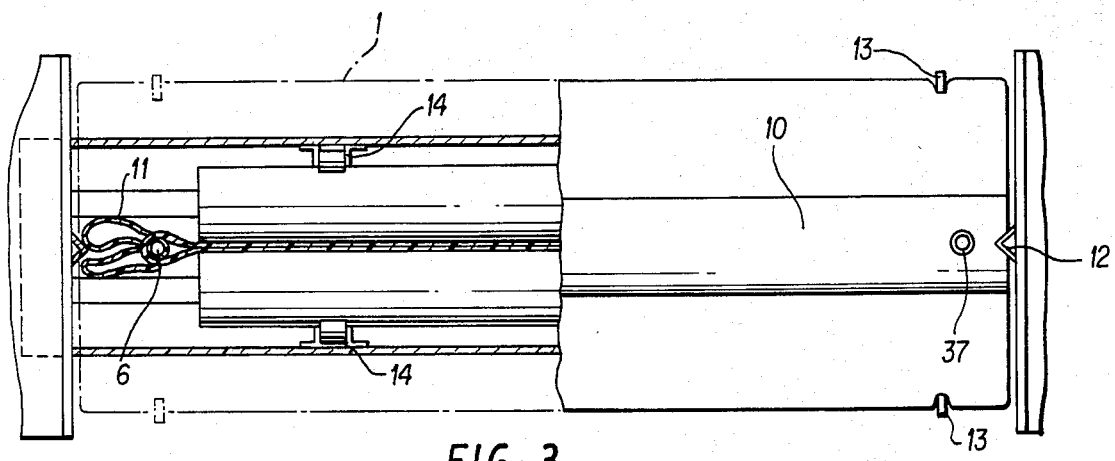
Figure 4:
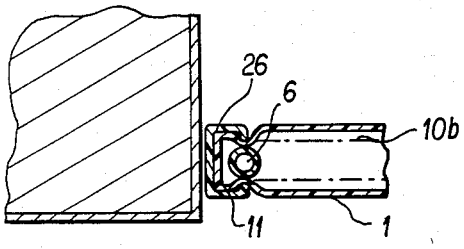
Figure 6:
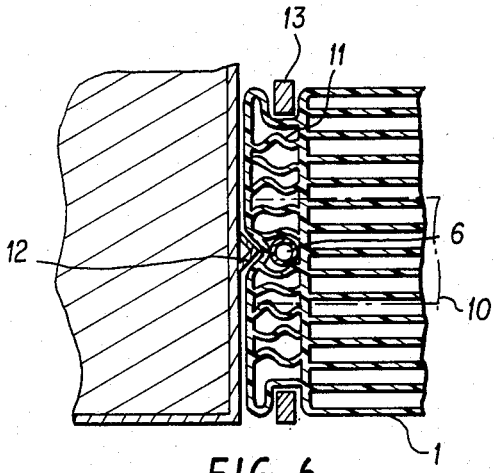
Figure 5:
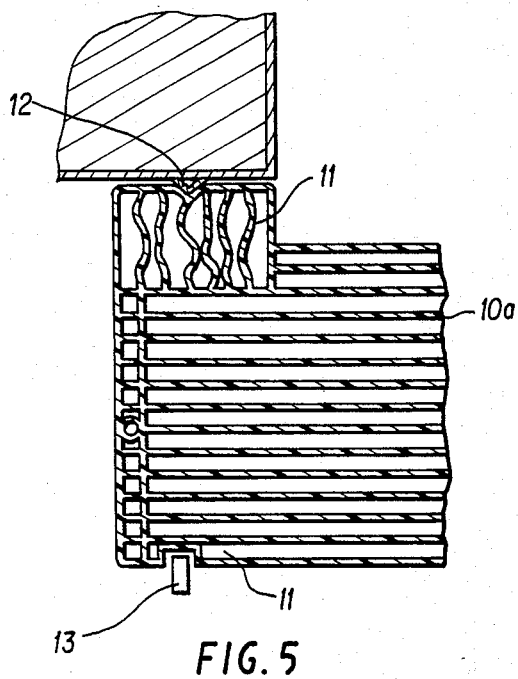
Figure 7:
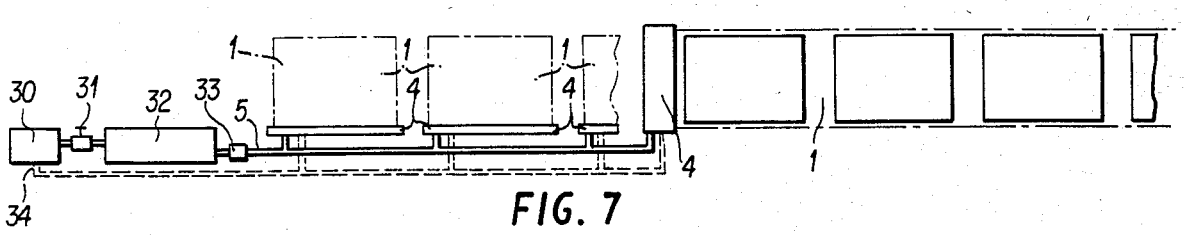
Figure 8:
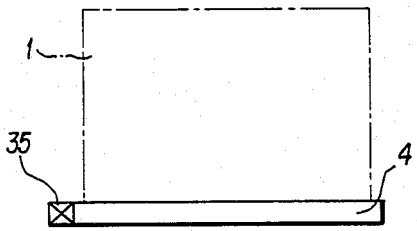
Figure 9:
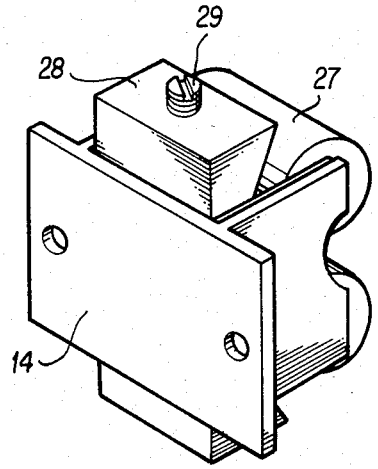
Figure 10:
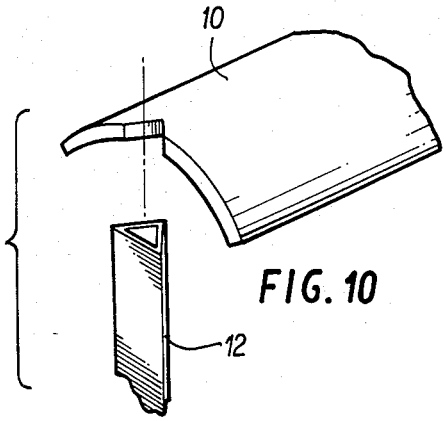
Figure 11:
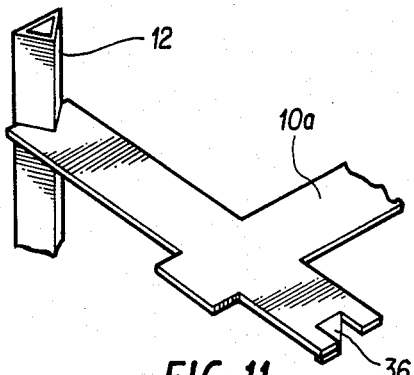
Figure 12:
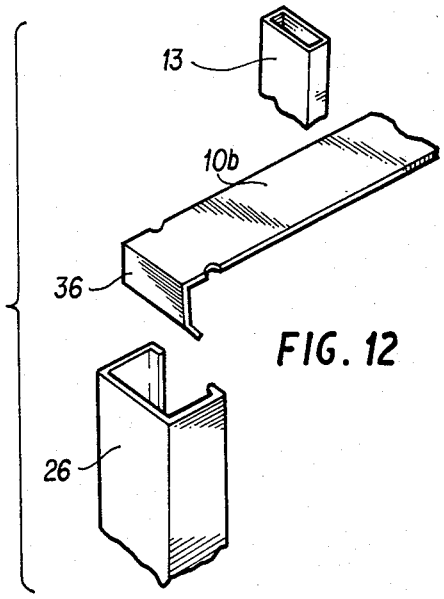
Figure 13:
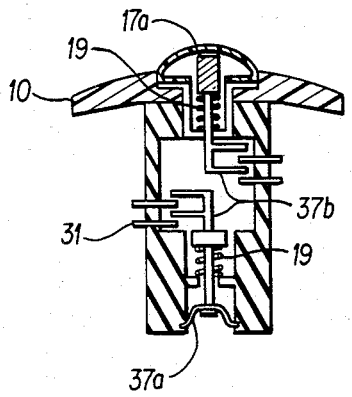
Figure 14:
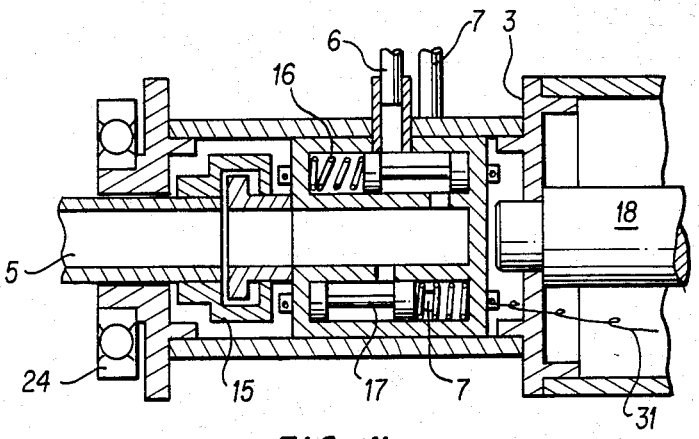
Figure 15:
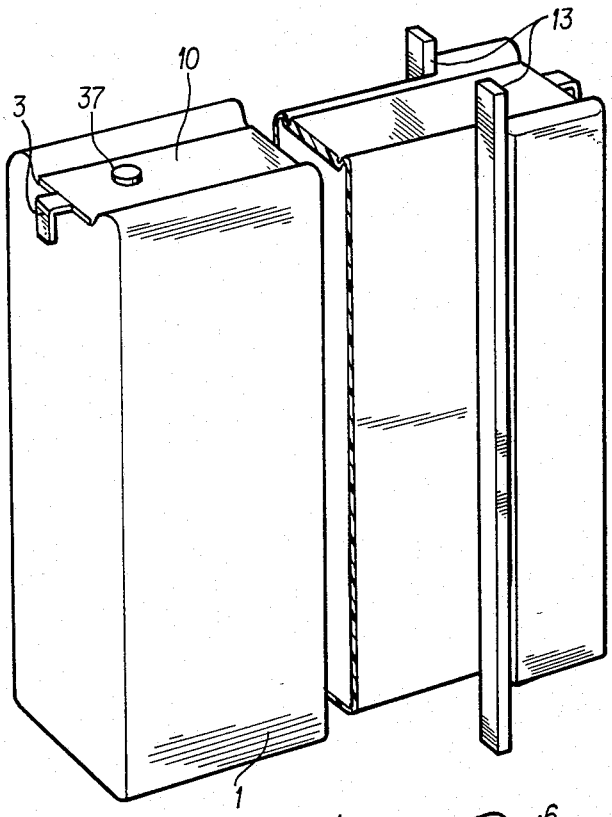
Figure 19:
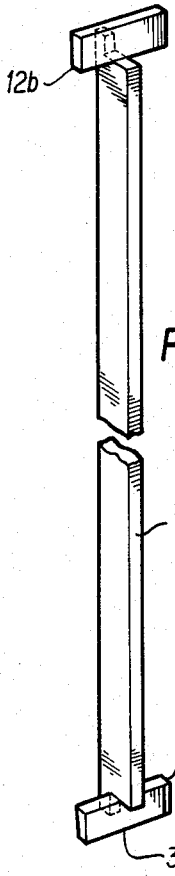
Figure 16:
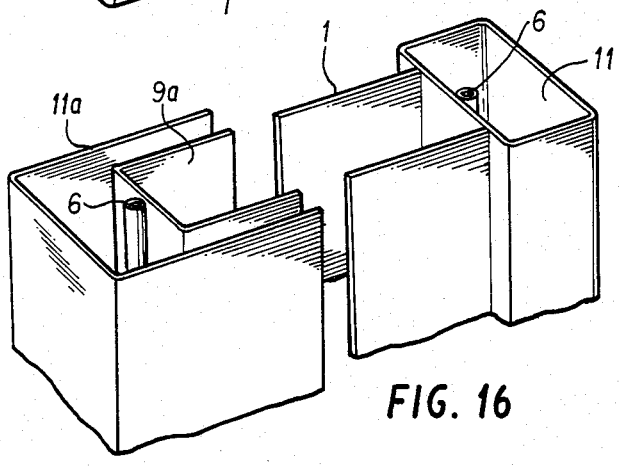
Figure 18:
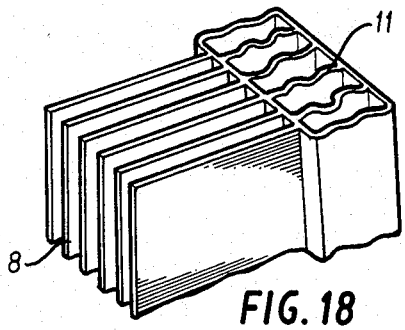
Figure 17:
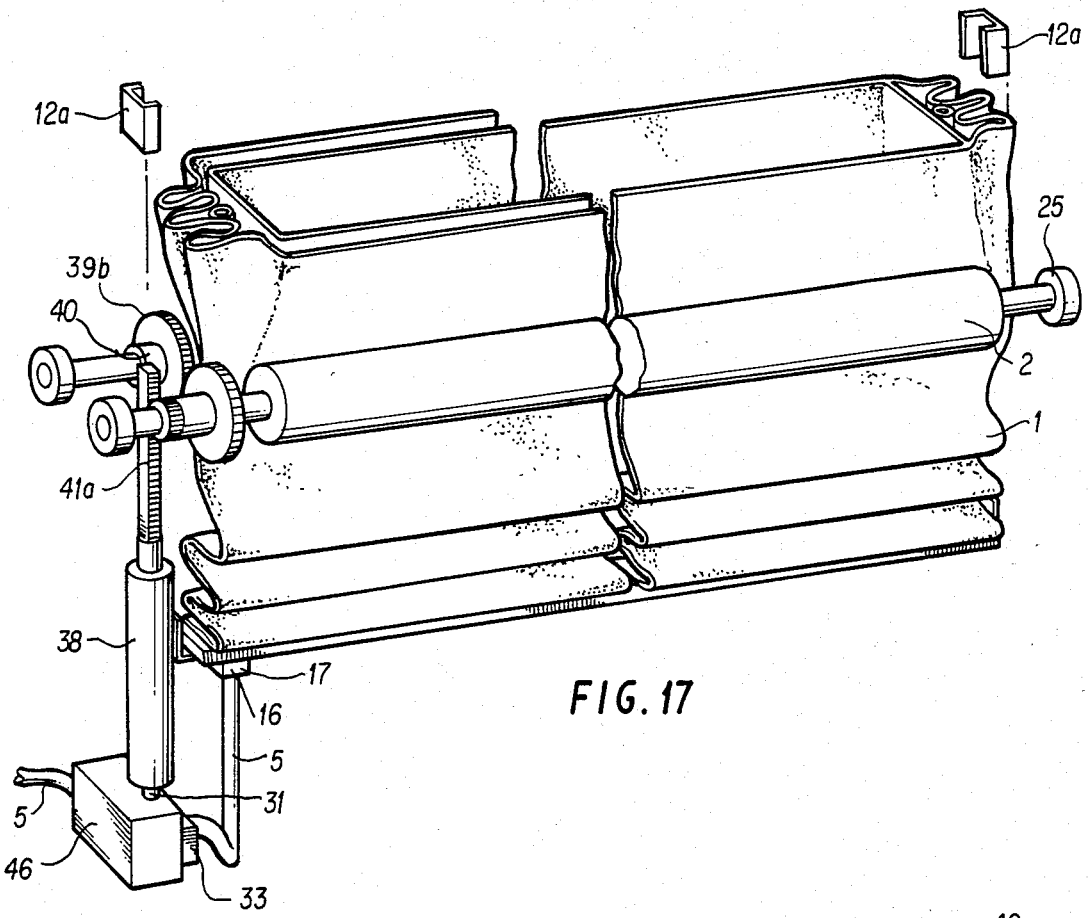
Figure 23:
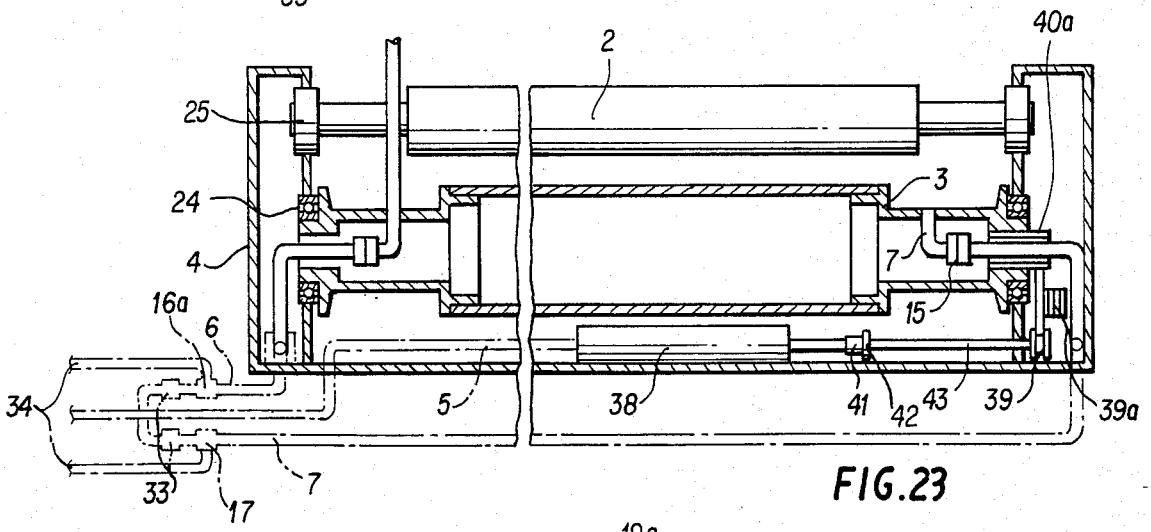
Figure 24:
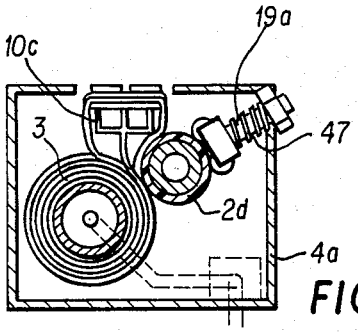
Figure 20:
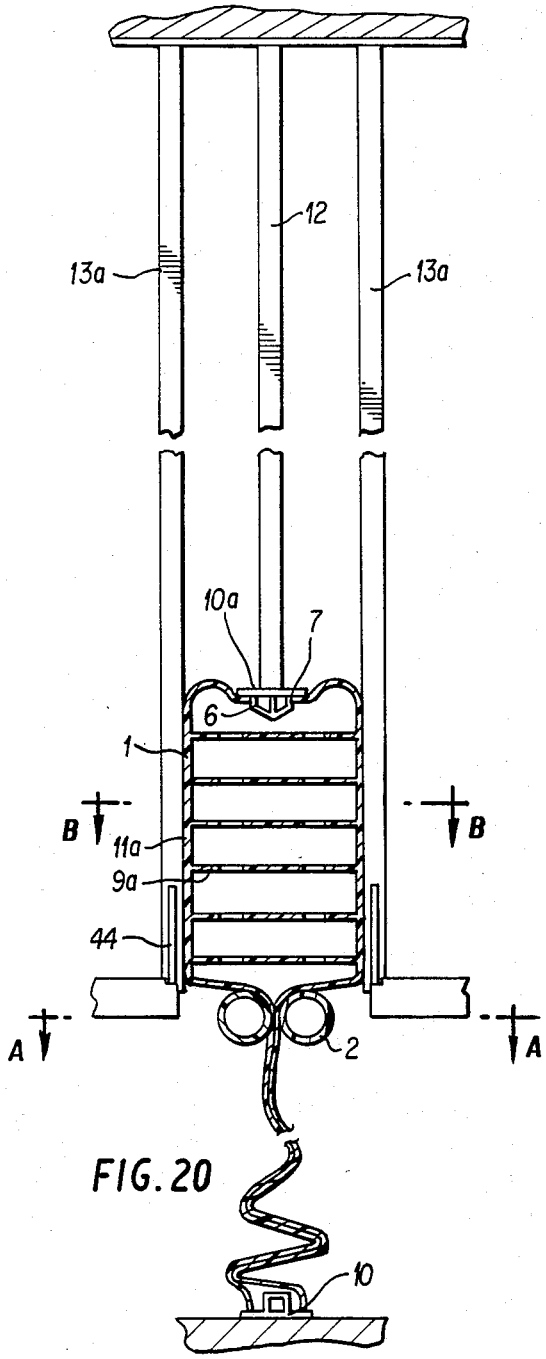
Figure 22:
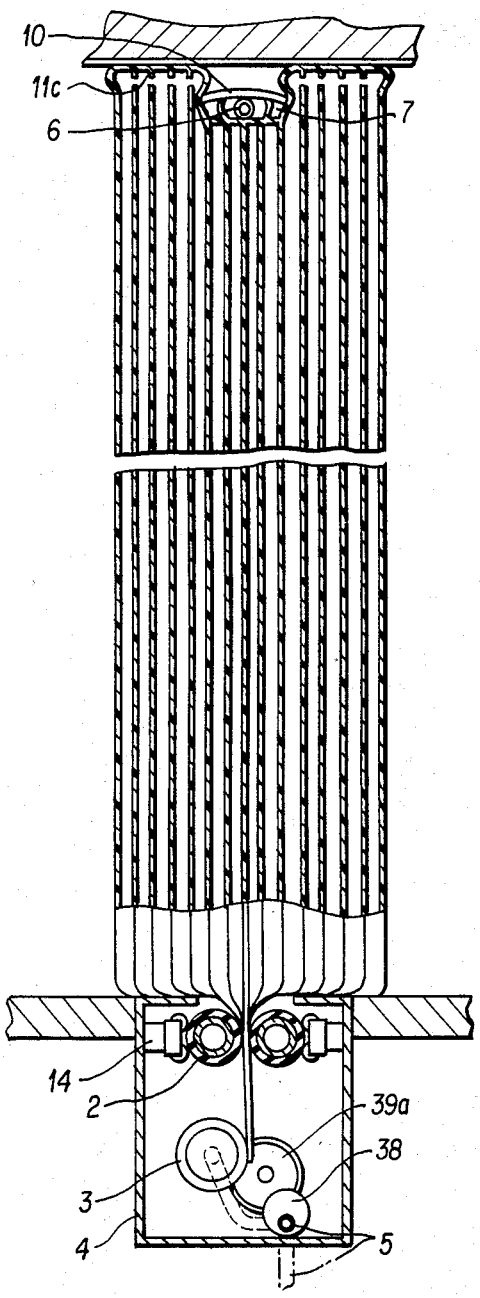
Figure 21:
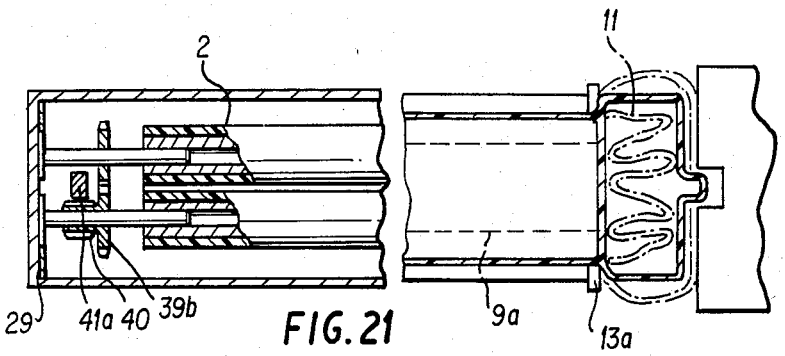
Figure 25:
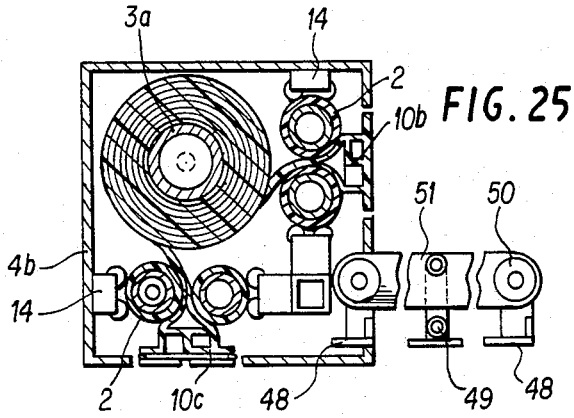
Figure 26:
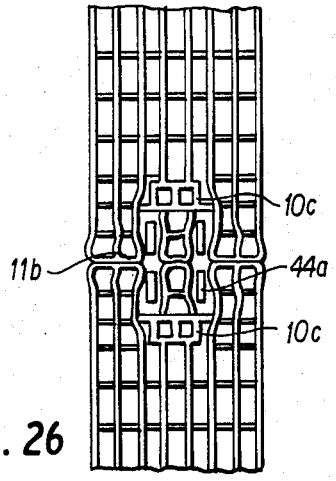
Figure 47:
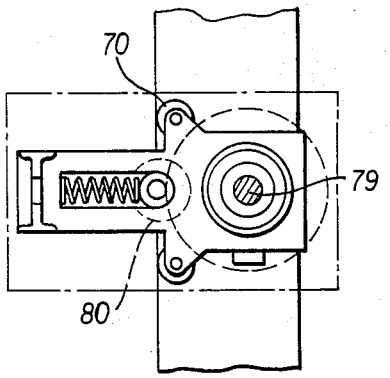
Figure 50:
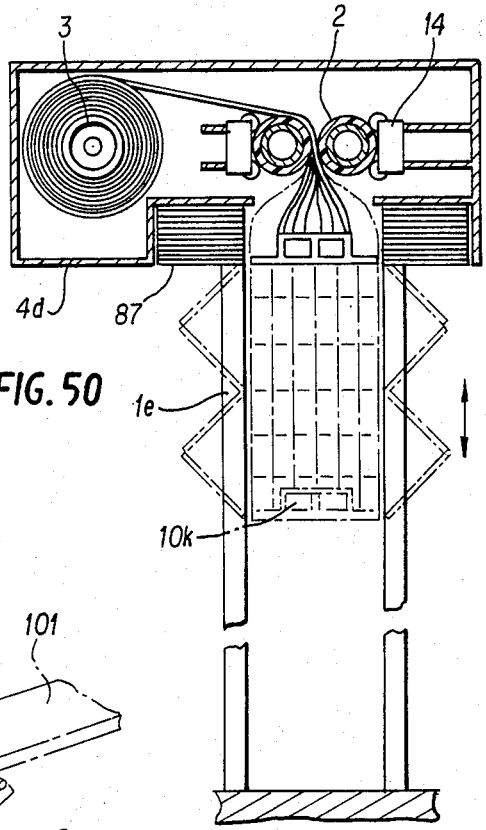

FIG. 50 illustrates an arrangement with a raisable and lowerable curtain which can be used as a door and where the storage part is arranged in a roof or the like. To prevent damage to the inflatable element, this can be protected by means of sheet 87 made from an impact-proof material which can be concertinaed together. The sheets are concertinaed in the storage part on either side of the curtain wall.

Figure 51:
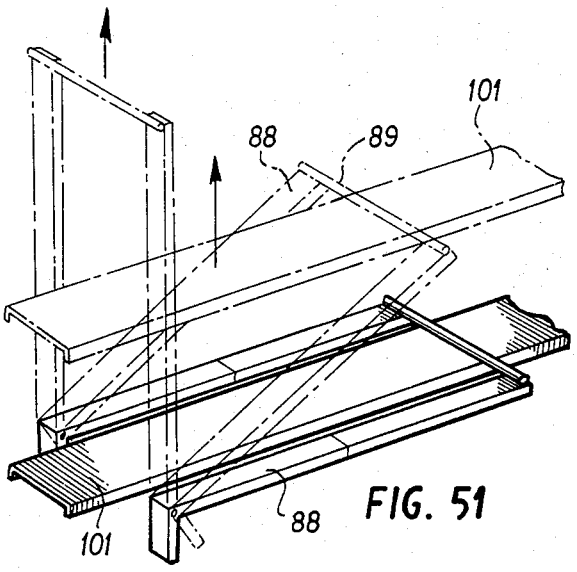
Figure 27:
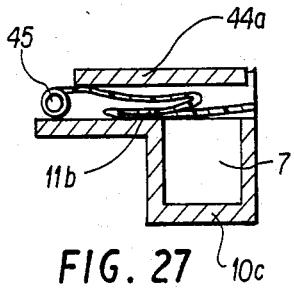
Figure 28:
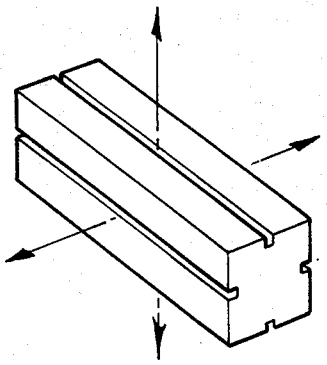
Figure 29:
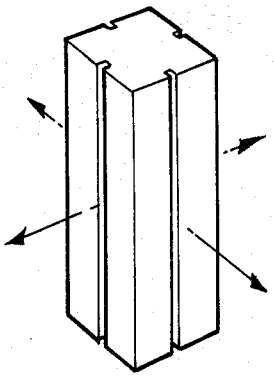
Figure 33:
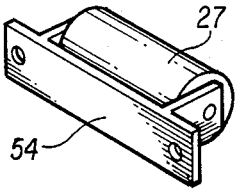
Figure 40:
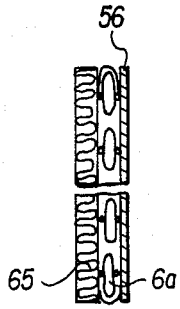
Figure 41:
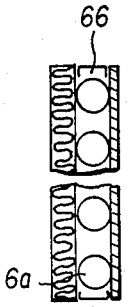
Figure 42:
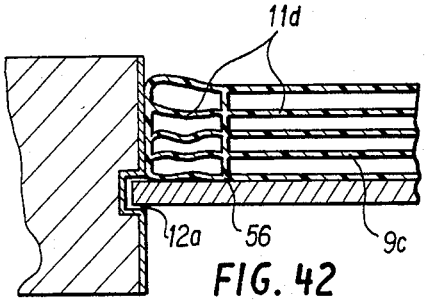
Figure 48:
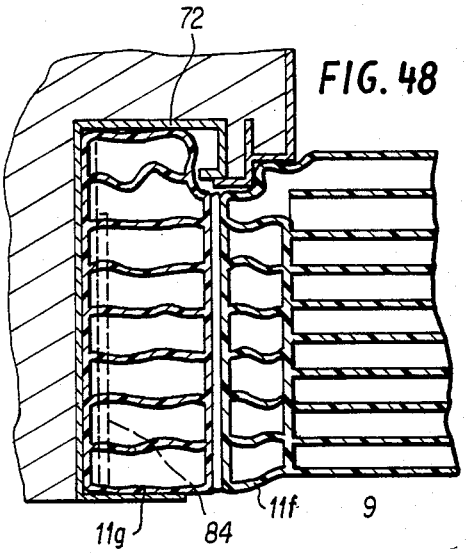
FIG. 48 illustrates an arrangement in which the sealing portion can be supplemented with further sealing portions intended to be filled with air simultaneously as the sealing portions are filled with air, thereby to reinforce the sealing effect.
Figure 49:
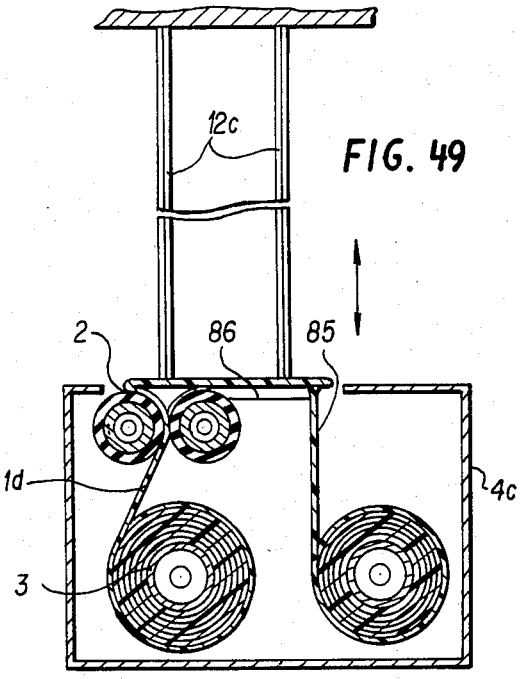
FIG. 49 illustrates another embodiment where the inflatable curtain can be protected from damage, e.g. in display windows, by means of a protective curtain 85 which is similarly reelable on a storage roller and which is attached to the upper edge of the curtain and particulates in this movement.
Figure 30:
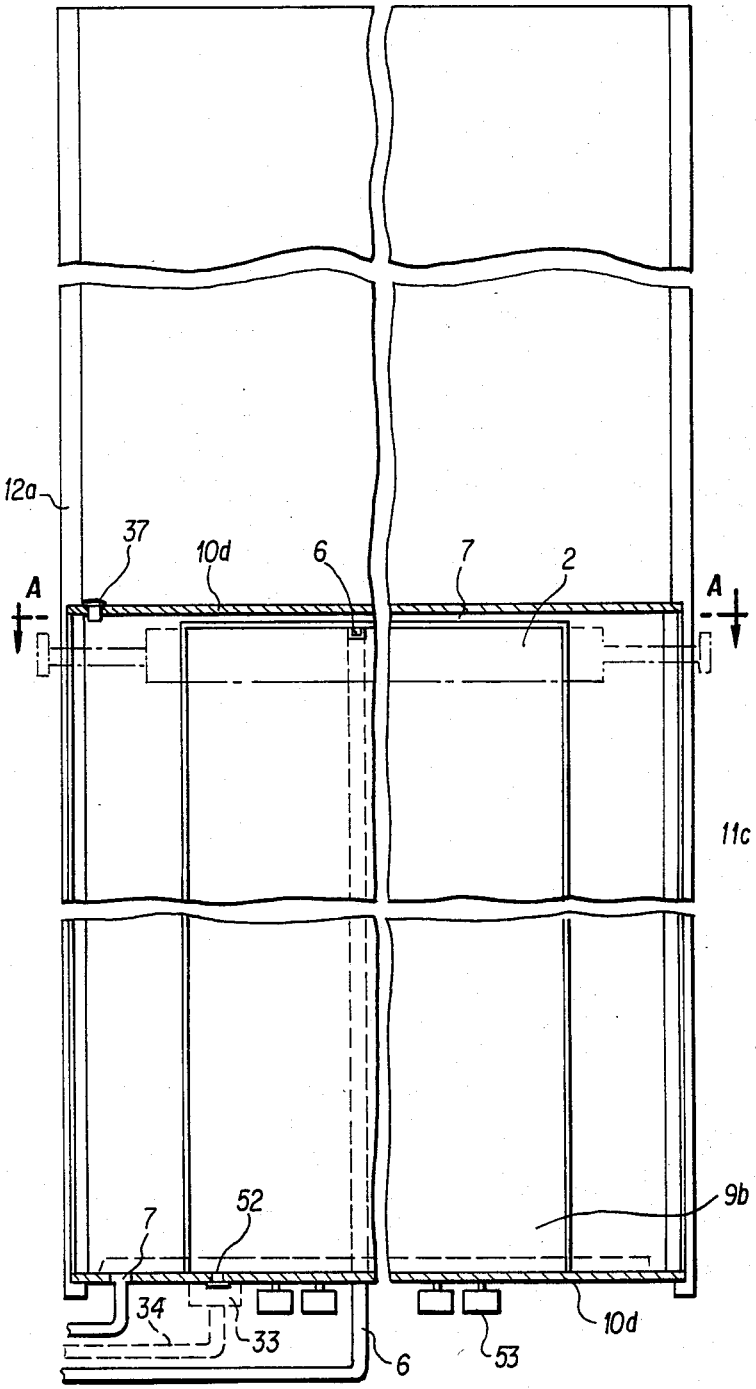
Figure 32:
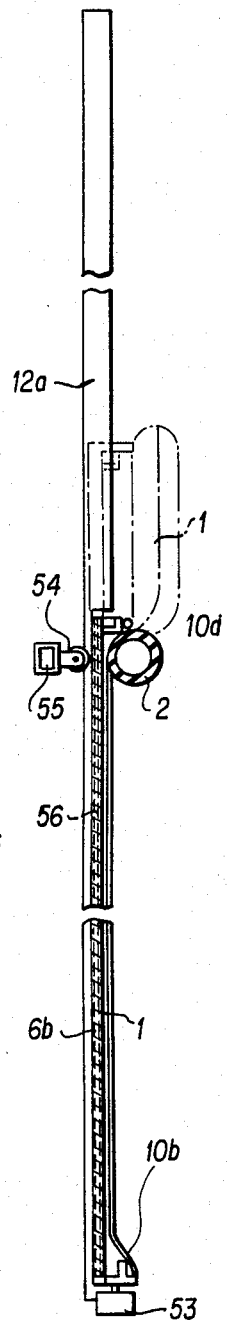
Figure 34:
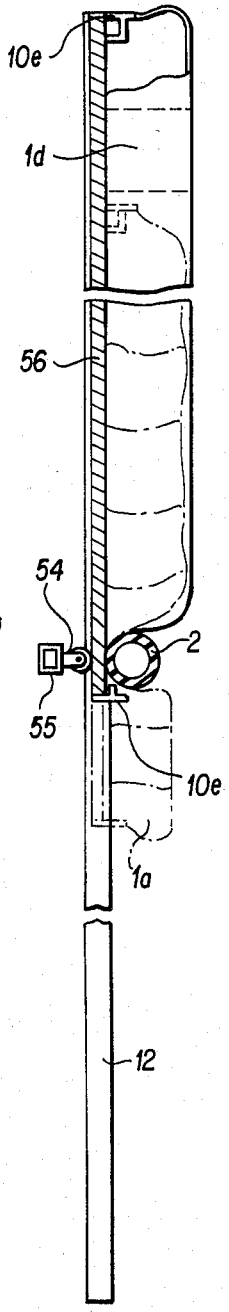
Figure 31:
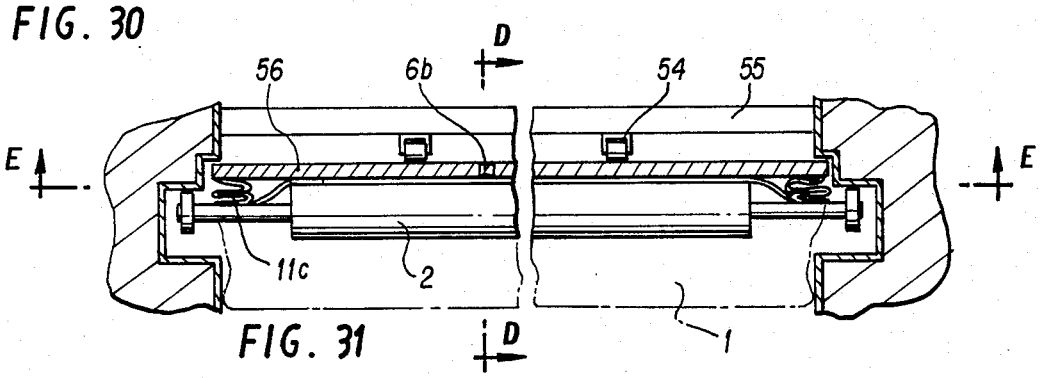
Figure 35:
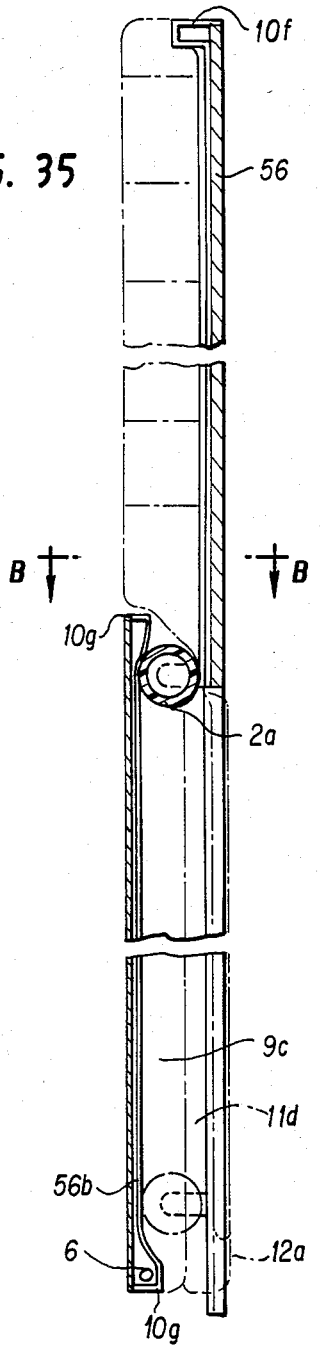
Figure 37:
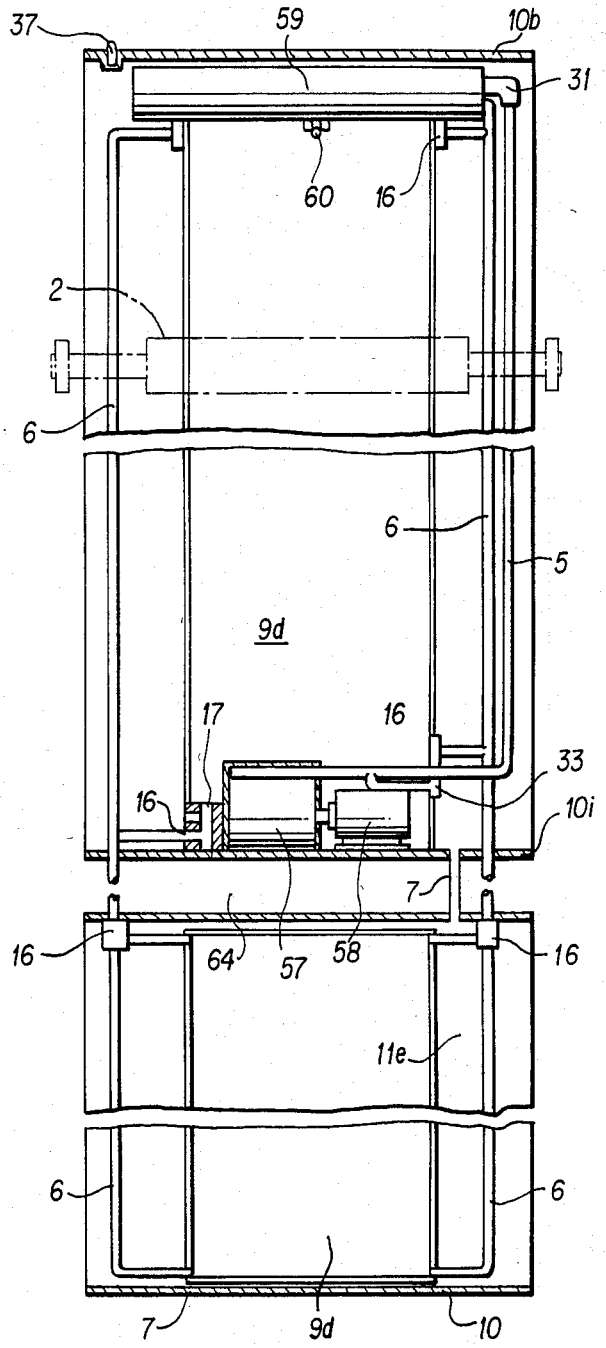
Figure 36:
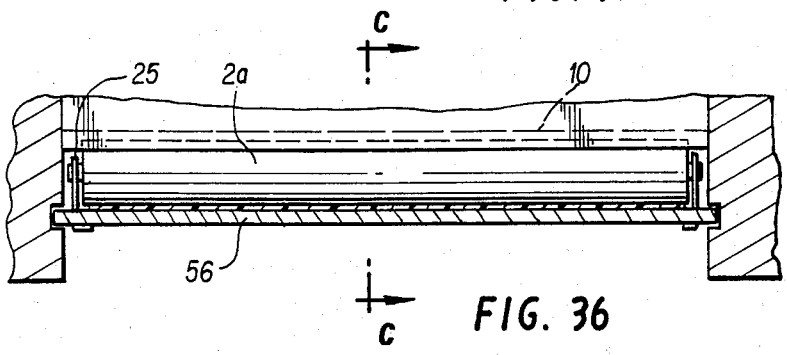
Figure 38:
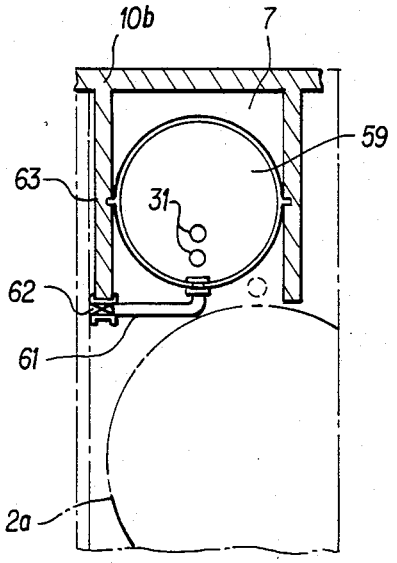

FIG. 51 illustrates a conceivable embodiment of guide elements intended to support the curtain during its upwards and reeling-in movement and to form bearing surfaces to the sealing portions in certain embodiments. The reinforced edge 101 will thus take with it the guide strips 88 in its movement upwards, by lifting a transverse rail 89 attached to one end of the strips, while the other end is pivotably mounted in a fixed portion.

Figure 52:
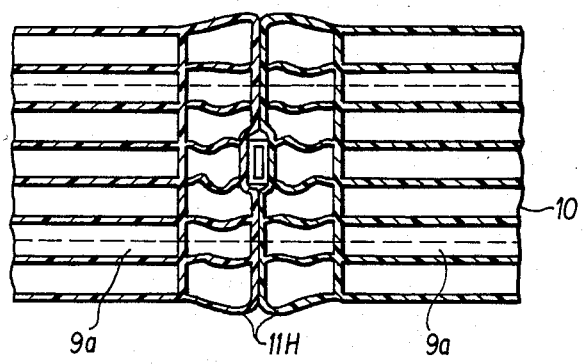
Figure 39:
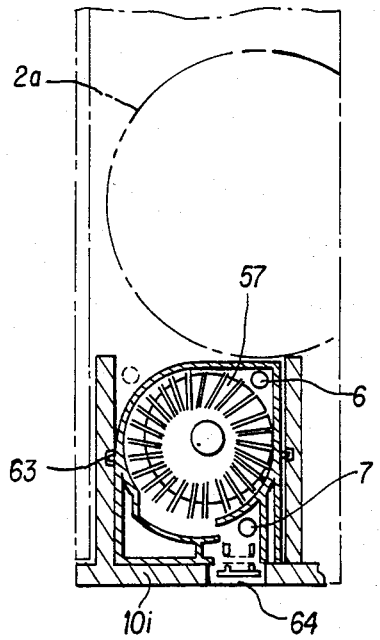
Figure 53:
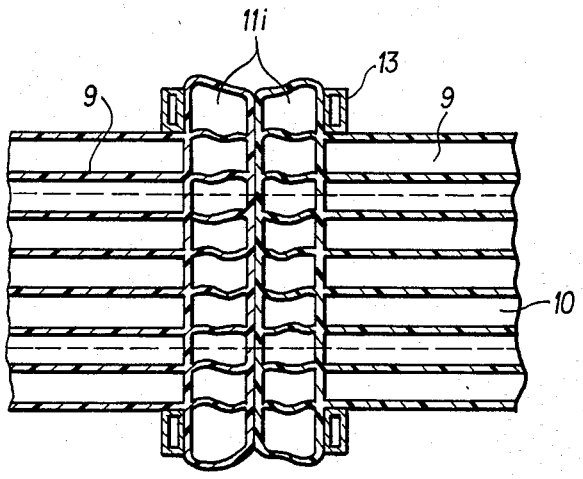
Figure 43:
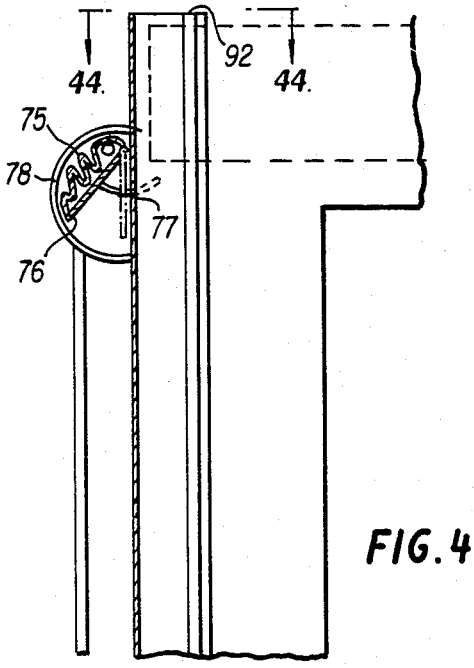
Figure 45:
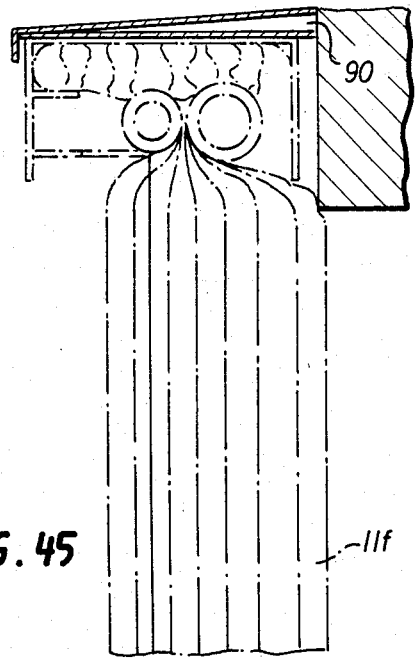
Figure 44:
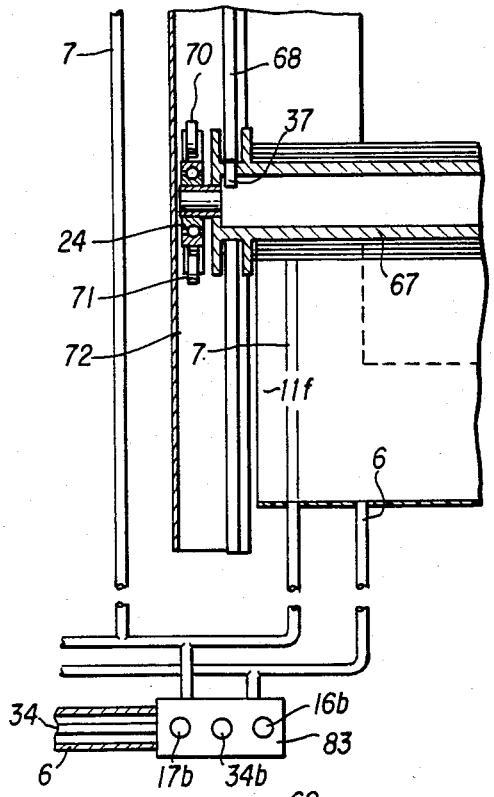
Figure 44:
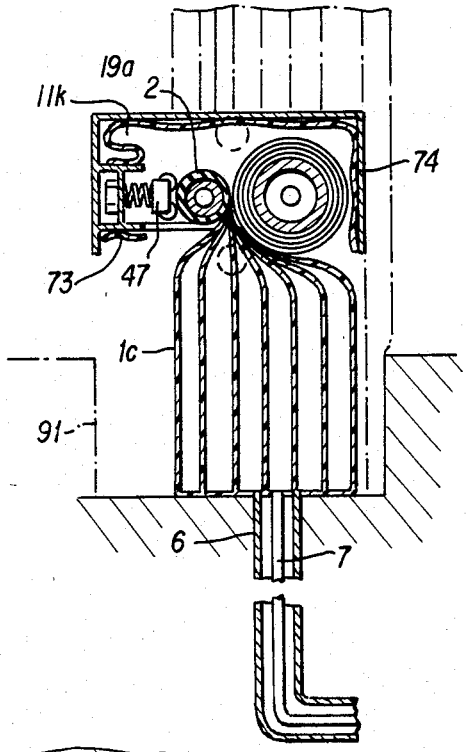
Figure 44:
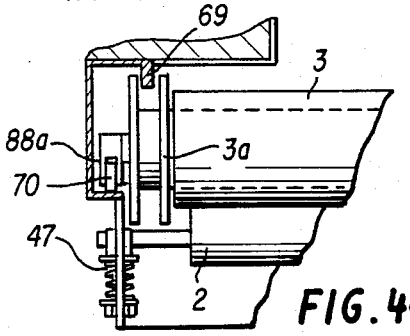
Figure 46:
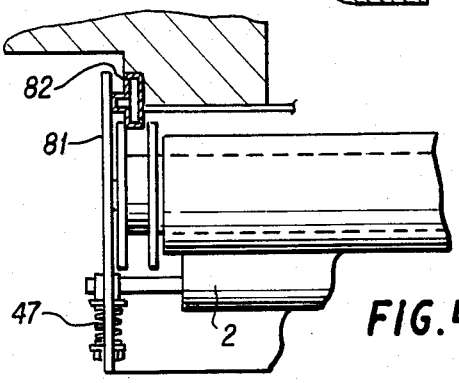

FIGS. 52 and 53 illustrate two different embodiments of seals between two parallel driven curtains, FIG. 52 illustrating a seal where there is a given pressure difference between the central portion 9*a* and the sealing portion 11*h*, resulting in that the central portion will be rigid in comparison with the sealing portions which yieldingly seal against each other and round a guide rail arranged between the curtains. FIG. 53 illustrates an arrangement where the sealing effect is achieved with the help of counterpressure rods 13, forming the sealing surfaces against which the sealing portions 11 expand, whereby the sealing portions are pressed against each other.

What is claimed is:

1. An insulating curtain assembly comprising:

(a) a flexible curtain element including an airtight central inflatable chamber and at least one airtight peripheral inflatable chamber, said airtight peripheral inflatable chamber being arranged so that, on being inflated, it expands against sealing surfaces, thereby substantially preventing air circulation to a predetermined area to be insulated by said curtain element;

(b) storage means for storage of said curtain element in a contracted state and from which said curtain element can be fed out to extend over the predetermined area;

(c) compression means adapted to effect generally linear airtight compression of said curtain element to subdivide, in airtight fashion, said airtight central inflatable chamber into an inflatable section disposed on that side of said curtain element which is beyond said compression means relative to said storage means and a non-inflatable section disposed on the same side of said compression means as said storage means; and (d) air supply means for supplying air sequentially first to said inflatable section of said airtight central inflatable chamber to thus cause inflation thereof and to generate a force at said compression means effective to feed out said curtain element and then to said at least one airtight peripheral inflatable chamber when said inflatable section of said airtight central inflatable chamber has reached its fed out position.

2. A curtain as recited in claim 1, characterized in that said compression means comprises two substantially parallel rollers.

3. A curtain as claimed in claim 1, characterized in that said compression means comprises one roller and a shaft onto which said flexible curtain element can be reeled.

4. A curtain is claimed in claim 3, characterized in that the compression means are arranged in a cassette, and when air is led to and from the airtight chambers said cassette is movable upwards and downwards, respectively, while the curtain element is reeled off and reeled on to said shaft, the bottom edge of the curtain being rigidly attached to a substructure and connected to the means for supply of air.

5. A curtain as claimed in claim 1, characterized in that two peripheral chambers are arranged on either side of the central chamber, being connected to each other by means of airducts and being arranged along opposing long sides of the inflatable element.

6. A curtain as claimed in claim 5, characterized in that the storage means comprises a shaft on which the inflatable curtain element can be reeled, and that the means for supplying air comprise controllable valve means which are connected at one end of the shaft and which via a rotating coupling are in combination with an air supply and by means of the airducts are connected to the airtight chambers.

7. A curtain as claimed in claim 1, characterized in that the airtight chambers are attached to an insulating slab or sheet which is movable into and out from said storage means.

8. A curtain as claimed in claim 1, characterized in that the peripheral chamber is attached to an insulating slab or sheet which is movable into and out of said storage means, while the central chamber is attached to a stationary substructure, and that the compression means comprise a roller arranged on the insulating sheet, and held by the substructure for the central chamber.

9. A curtain as claimed in claim 1, characterized in that guiding elements are provided to guide movements of the inflatable curtain element as it is fed out from the storage means, there being sensing elements actuable by the curtain element for commencing inflation of the peripheral chamber when the curtain has reached an end position.

10. A curtain as claimed in claim 1, characterized in that the air supply means include pressure regulating means, adapted for controlling the pressure in the airtight chambers so that the pressure in the central chamber is greater than in the peripheral chamber.

11. An insulating curtain assembly comprising:

(a) a flexible curtain element including an airtight central inflatable chamber and at least one airtight peripheral inflatable chamber, said airtight peripheral inflatable chamber being arranged so that, on being inflated, it expands against sealing surfaces, thereby substantially preventing air circulation to a predetermined area to be insulated by said curtain element;

(b) storage means for storage of said curtain element in a contracted state and from which said curtain element can be fed out to extend over the predetermined area;

(c) compression means adapted to effect generally linear airtight compression of said curtain element to subdivide, in airtight fashion, said airtight central inflatable chamber into an inflatable section disposed on that side of said curtain element which is beyond said compression means relative to said storage means and a non-inflatable section disposed on the same side of said compression means as said storage means;

(d) air supply means for supplying air sequentially first to said inflatable section of said airtight central inflatable chamber to thus cause inflation thereof and to generate a force at said compression means effective to feed out said curtain element and then to said at least one airtight peripheral inflatable chamber when said inflatable section of said airtight central inflatable chamber has reached its fed out position; and (e) air-evacuating means for emptying said at least one airtight peripheral inflatable chamber first and thereafter emptying said inflatable section of said airtight central inflatable chamber when the emptying of said airtight peripheral inflatable chamber is at least substantially terminated, the emptying of said at least one airtight peripheral inflatable chamber and said inflatable section of said airtight central inflatable chamber being effected in conjunction with the feeding of said curtain element into said storage means.

12. A curtain as claimed in claim 1, characterized in that each sealing surface includes two pivotable strips arranged along the long sides of the curtain element, said strips being lockable and adapted to form counter supports at the expansion of the peripheral chamber between the strips and a sealing surface lying thereagainst.

* * * * *